US005357048A

United States Patent [19]

Sgroi

[11] Patent Number: 5,357,048

[45] Date of Patent: Oct. 18, 1994

[54] MIDI SOUND DESIGNER WITH RANDOMIZER FUNCTION

[76] Inventor: John J. Sgroi, 112 Edward St., Schenectady, N.Y. 12304

[21] Appl. No.: 958,264

[22] Filed: Oct. 8, 1992

[51] Int. Cl.[5] ..... G10H 5/00

[52] U.S. Cl. ..... 84/645; 84/622; 84/633

[58] Field of Search ..... 84/622, 633, 645, 659, 84/665

[56] References Cited

U.S. PATENT DOCUMENTS

| | | | |
|---|---|---|---|
| Re. 31,004 | 8/1982 | Niimi | 84/645 |
| 4,026,180 | 5/1977 | Tomisawa et al. | 84/629 |
| 4,148,239 | 4/1979 | Oya et al. | 84/605 |
| 4,777,857 | 10/1988 | Stewart | 84/645 |
| 4,785,702 | 11/1988 | Katoh | 84/604 |
| 5,074,183 | 12/1991 | Caihana | 84/615 |
| 5,099,738 | 3/1992 | Hotz | 84/617 |
| 5,164,530 | 11/1992 | Iwase | 84/624 |

OTHER PUBLICATIONS

"Oberheim Systemizer, Navigator, & Cyclone MIDI Data Processors", Jim Aikin; *Keyboard Report,* May 1989; pp. 128–134.

*Primary Examiner*—William M. Shoop, Jr.
*Assistant Examiner*—Jeffrey W. Donels
*Attorney, Agent, or Firm*—Heslin & Rothenberg

[57] ABSTRACT

A MIDI Controller has the capability to automatically randomize, on multiple MIDI channels, four key elements of sound, namely timbre, pitch, volume, and dynamic response, to produce new total sounds. The MIDI Controller includes a user configurable randomizer which can selectively randomize the four key sound elements through processor operators. The randomizer includes a random number generator, the output of which is selectively truncated depending upon the particular element being randomized.

34 Claims, 15 Drawing Sheets

MIDI SOUND DESIGNER WITH RANDOMIZER FUNCTION

BACKGROUND OF THE INVENTION

1. The Field of the Invention

The present invention relates generally to electronic musical systems, and more particularly, to such systems interfaced and controlled via the Musical Instrument Digital Interface (MIDI).

2. Background Information

For competitive differentiation, musicians seek new sounds. Sounds contain certain significant elements (pitch, amplitude, timbre, etc) analogous to colors (frequency, intensity, etc.). In a musical context, a musical sound is made up of certain elements; the combination of these sonic ingredients is how music is made.

As schematically illustrated in FIG. 1, a Total Sound (20) is a combination (18) of timbres (16). Timbre is the quality in sound that distinguishes one sound from another. Timbres (16) can be electronically synthesized using a combination (14) of waveforms (10) and waveform modifiers (12). New Total Sounds can be created by developing new waveforms and modifiers, new timbres, and/or by developing new timbral combinations.

Electronic synthesizers have introduced many new waveforms and waveform modifiers, thus leading to new timbres which lead to new Total Sounds. However, this process of developing new sounds has been difficult for musicians to apply. Developing new sounds has required creating and manipulating waveforms and modifiers which is tedious and too technically demanding for most musicians. In addition, each synthesizer has unique parameters for waveforms and modifiers, and each synthesizer manufacturer has its own operating system to program such parameters. The skills and knowledge required to develop new Total Sounds by this method is as particular as each synthesizer's parameters and operating system. Therefore, a need exists to create new Total Sounds independent of synthesizers' parameters or operating systems.

Another means of developing new Total Sounds is by uniquely combining individual timbres. This can be accomplished using MIDI to control multiple sound generators. MIDI has a standardized set of commands and parameters. The benefit of using MIDI is its portability, i.e., MIDI programming skills can be transported and applied to any MIDI Sound Generator and to any MIDI system.

MIDI is a hardware and software specification voluntarily adhered to by manufacturers of electronic musical instruments and other related products. MIDI is a control protocol whose primary function is to control one device from another device. For example the controlling device would instruct the slave device(s) to turn on a certain note at a desired level. For more information on MIDI, refer to the Detailed MIDI Specification 1.0 published by the MIDI Manufacturer's Association.

A MIDI electronic musical system typically includes a MIDI controller which controls a plurality of MIDI sound generators. Audio signals from the sound generators are combined and broadcast by a sound system to produce the audible Total Sound. Today's sophisticated MIDI controllers are typically menu driven. Although faster than manual control and adjustment of numerous function knobs, menu selection of a desired function may inhibit, rather than enhance, the creative flow of a musician.

A need thus exists for a MIDI controller which facilitates development of new Total Sounds, without inhibiting the musician's creativity.

SUMMARY OF THE INVENTION

The above described needs are satisfied, the limitations of the prior art overcome, and additional benefits achieved, in accordance with the principles of the present invention, through the provision of a MIDI controller having a randomizer function.

The present invention is premised upon the recognition that the most important elements in the construction of new Total Sounds are timbre, pitch, volume and dynamic response. The MIDI controller of the present invention assigns pseudorandom values to these elements to create new and unique sounds. The randomizing function of the present invention performs a form of high level additive synthesis, wherein entire timbres are uniquely combined to create new sounds.

The present invention provides a means to randomly develop timbral combinations, a means to select which elements are randomized, and a means to manually edit these and other elements to produce the desired Total Sound.

Accordingly, it is an object of the present invention to produce new and unique Total Sounds based on both random configuration of particular elements and configurations based on the user's options to combine only certain elements of choice and to create sound samples of these combinations to be heard, selected and retained in memory. The ability to choose only certain elements to be randomly configured by the system allows the user to guide the direction of the sound layers being created to produce those sounds desired, but in unique configurations that would be virtually impossible for the user to create because of the complexity of the interaction it would take with the individual sound generating sources.

According to the present invention, a MIDI controller with the randomizer function develops new sounds by pseudorandomly combining the four key elements in a timbral combination utilizing the industry standard MIDI protocol. The randomizer function frees the musician from the underlying technology enhancing the musician's creativity and allowing the musician to selectively guide the automatic generation of desired new Total Sounds.

These and other objects, features and advantages of the present invention will be more readily understood from the following detailed description of a preferred embodiment, when read in conjunction with the accompanying drawings.

DETAILED DESCRIPTION

Figure 1:
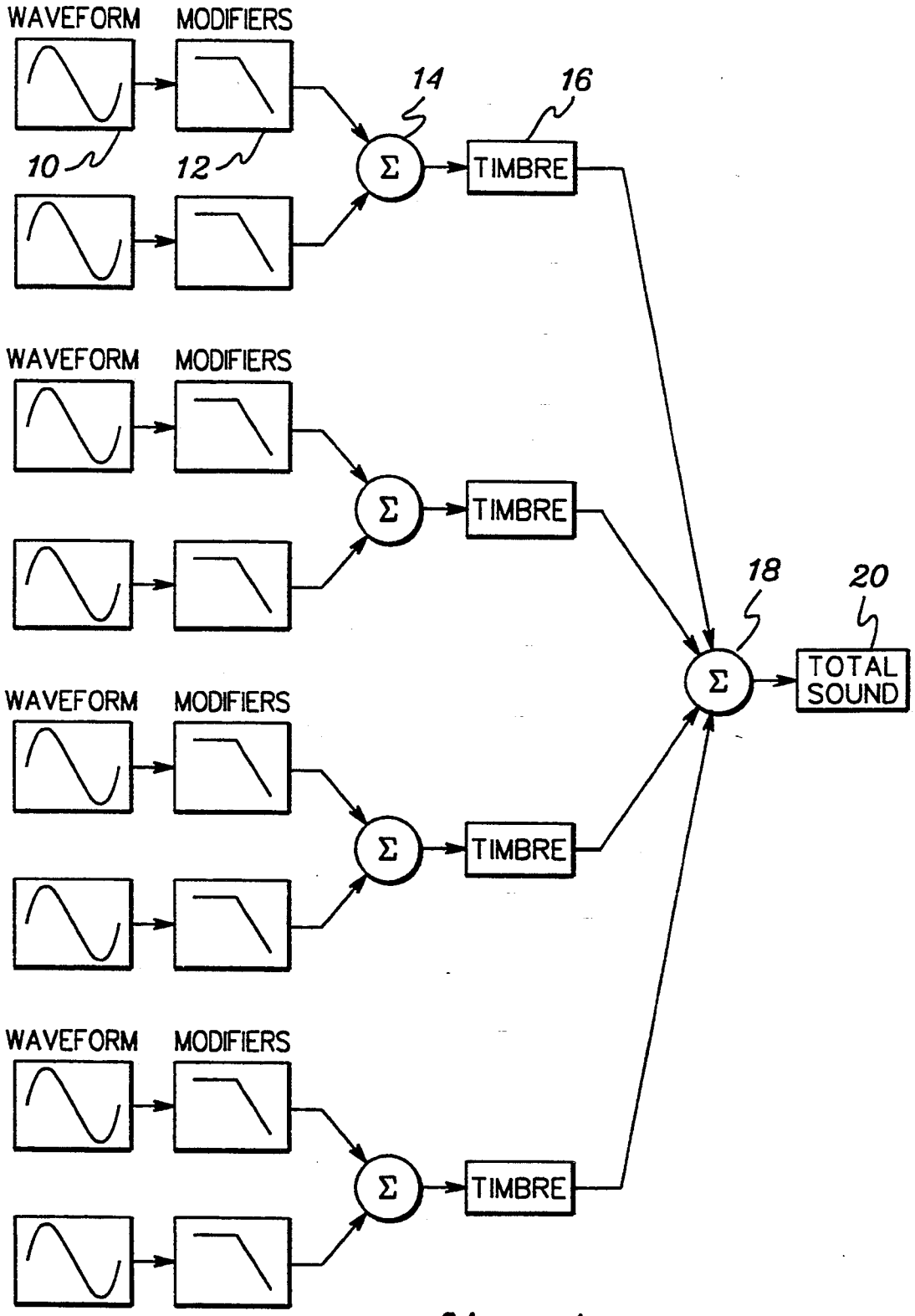
FIG. 1 shows components of a Total Sound.
Figure 2:
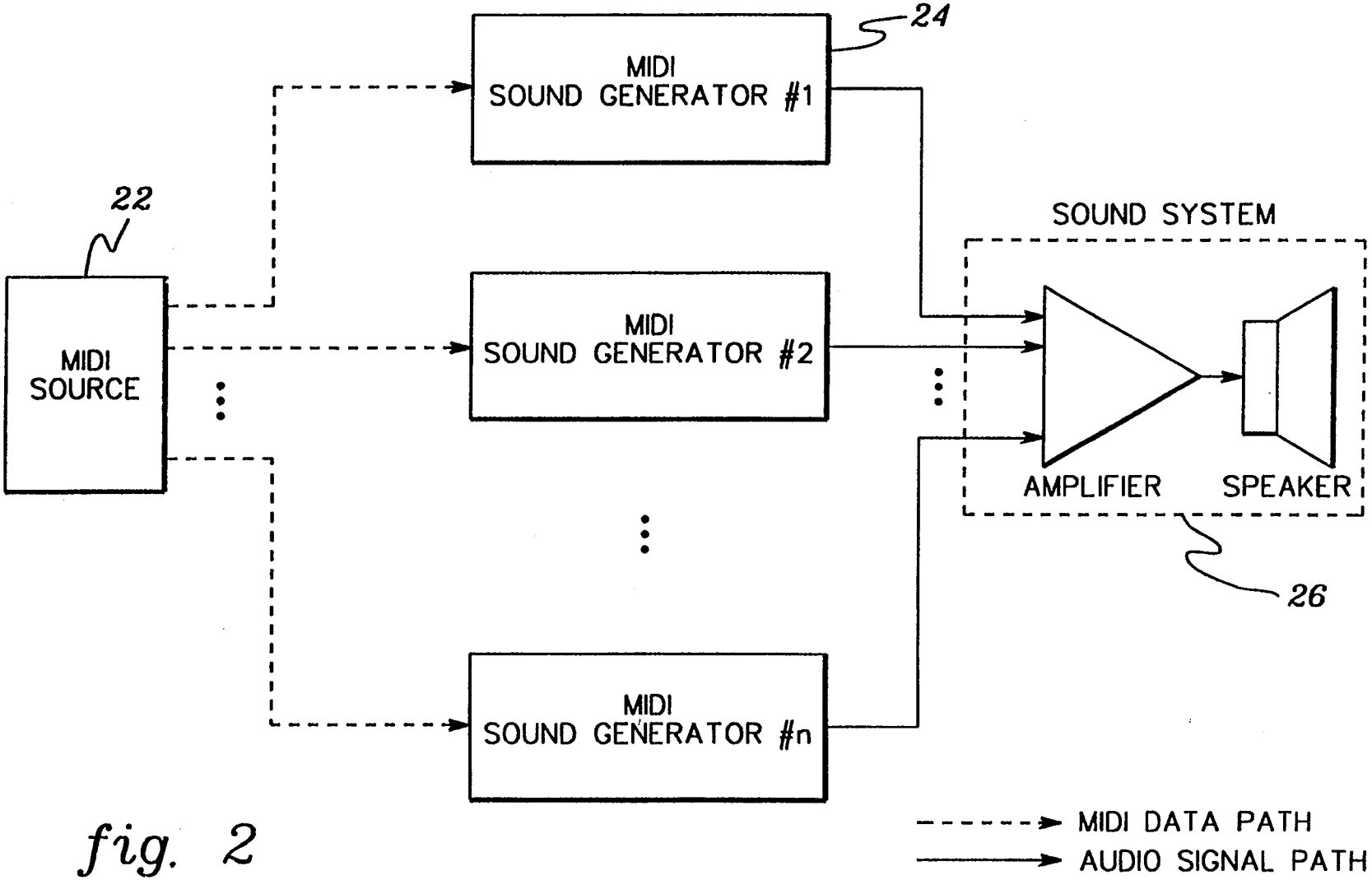
FIG. 2 depicts a typical MIDI electronic music system.

For music performance applications, a MIDI electronic musical system, as shown in FIG. 2, typically includes a MIDI Source (22) which controls a plurality of MIDI Sound generators (24) via MIDI, and a sound system (26) through which the sound is heard. Typically the musician produces notes on the MIDI source. The MIDI source (22) then instructs certain MIDI sound generators (24) as to which timbre to use, which notes to play, the volume at which the notes are played, etc. The audio signal is amplified and heard through speakers of sound system 26.

Figure 3:
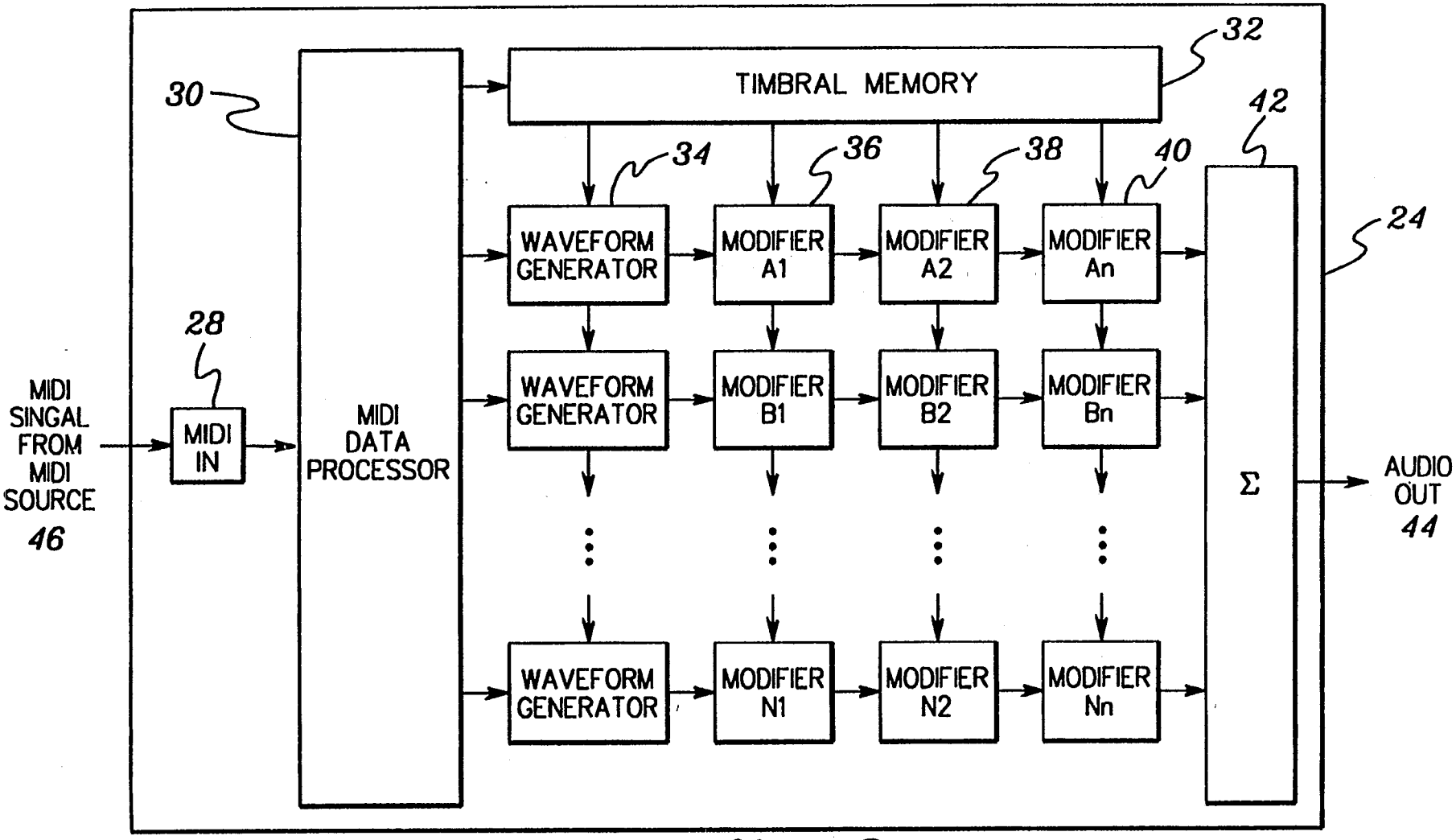
FIG. 3 presents a functional block diagram of a typical MIDI Sound Generator.

FIG. 3 illustrates an electronic synthesizer that can be controlled via MIDI, and is commonly known in the field and referred to herein as a MIDI Sound Generator (24). A MIDI signal (46) emanates from the MIDI source and enters the MIDI Sound Generator through the MIDI IN port (28). The MIDI Sound Generator (24) contains an internal MIDI processor (30) which determines how to respond to the incoming MIDI commands.

MIDI sound generators are capable of changing timbres, playing notes, modifying notes, among other tasks, via MIDI. The configuration of waveform generators and modifiers changes for each timbre produced. Each timbre is stored and recalled from timbral memory (32).

When playing notes, each note starts in a Waveform Generator (34) and is modified by any number of Waveform Modifiers (36–40). The outputs are then summed (42) to produce the audio output (44). Waveforms are generated and modified through a variety of known technologies. Such MIDI sound generators are available from a variety of sources, including Yamaha and Ensoniq.

Referring again to FIG. 2, the MIDI signal for each MIDI sound generator (24) comes from a MIDI source (22). MIDI source (22) can be any device which generates MIDI data. MIDI controllers, synthesizers, sequencers, etc. are examples of MIDI sources commonly known in the field.

Figure 4:
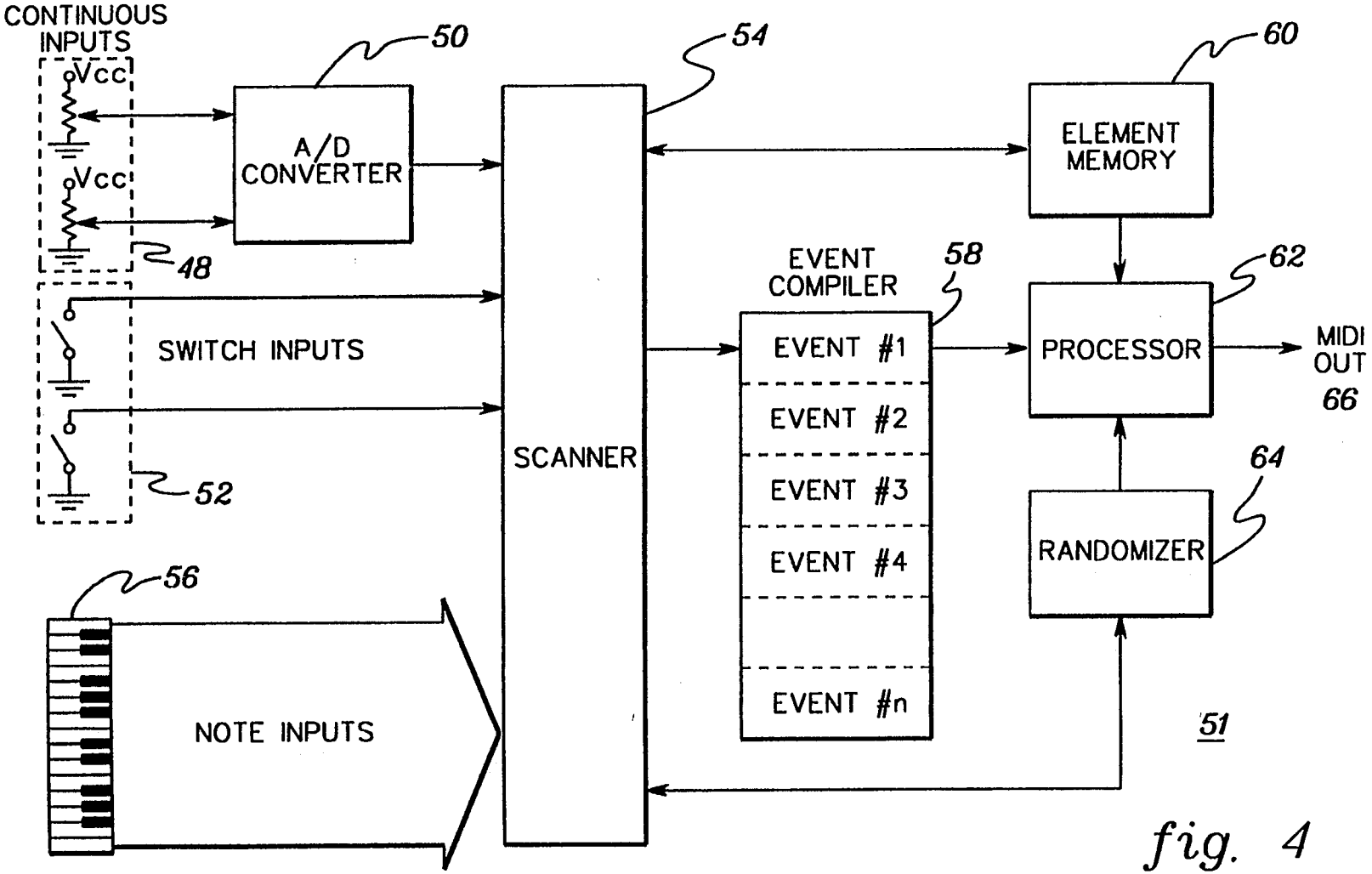
FIG. 4 is a functional block diagram of a MIDI Controller with Randomizer, constructed in accordance with the principles of the present invention.

One common source of MIDI data is a MIDI Controller. A MIDI controller (51) constructed according to the principles of the present invention is illustrated in FIG. 4. The primary function of a MIDI Controller is to produce MIDI commands based on human input. MIDI Controllers have an input device to generate notes. The input used for notes is typically capable of determining the dynamic response of the notes. A typical device for producing note input is a keyboard (56), though other input devices may be used. Keyboards often use a dual contact method to discern the speed at which the key was struck, i.e. "Key Speed," which determines the dynamic response of the note. Methods of determining the dynamic response of notes, other than a dual contact keyboard, currently exist.

MIDI controller 51 includes a plurality of note modifiers (48) that produce continuous inputs which are A/D converted by A/D converter (50) and used as inputs by a scanner (54). Controller 51 also has numerous switch inputs (52) that are used as note modifiers and also to operate and program the apparatus through the scanner (54).

Scanner (54) is preferably implemented as a programmed microcontroller with RAM, ROM, A/D converter, timer and parallel ports. The primary function of scanner (54) is to generate Events based on changes on the inputs (48,52,56). When the scanner recognizes a change of state, it generates the proper Event based on the contents of an Element Memory (60) and writes the Event to an Event Compiler (58) which is typically a First-In-First-Out (FIFO) buffer.

An Event is a change of input state from which either MIDI commands will be generated, or an internal function is executed. Examples of Events are: Note On Event, Note Off Event, Timbre Change Event, Volume Change Event, Pitch Bend Event, etc.

Figure 5:
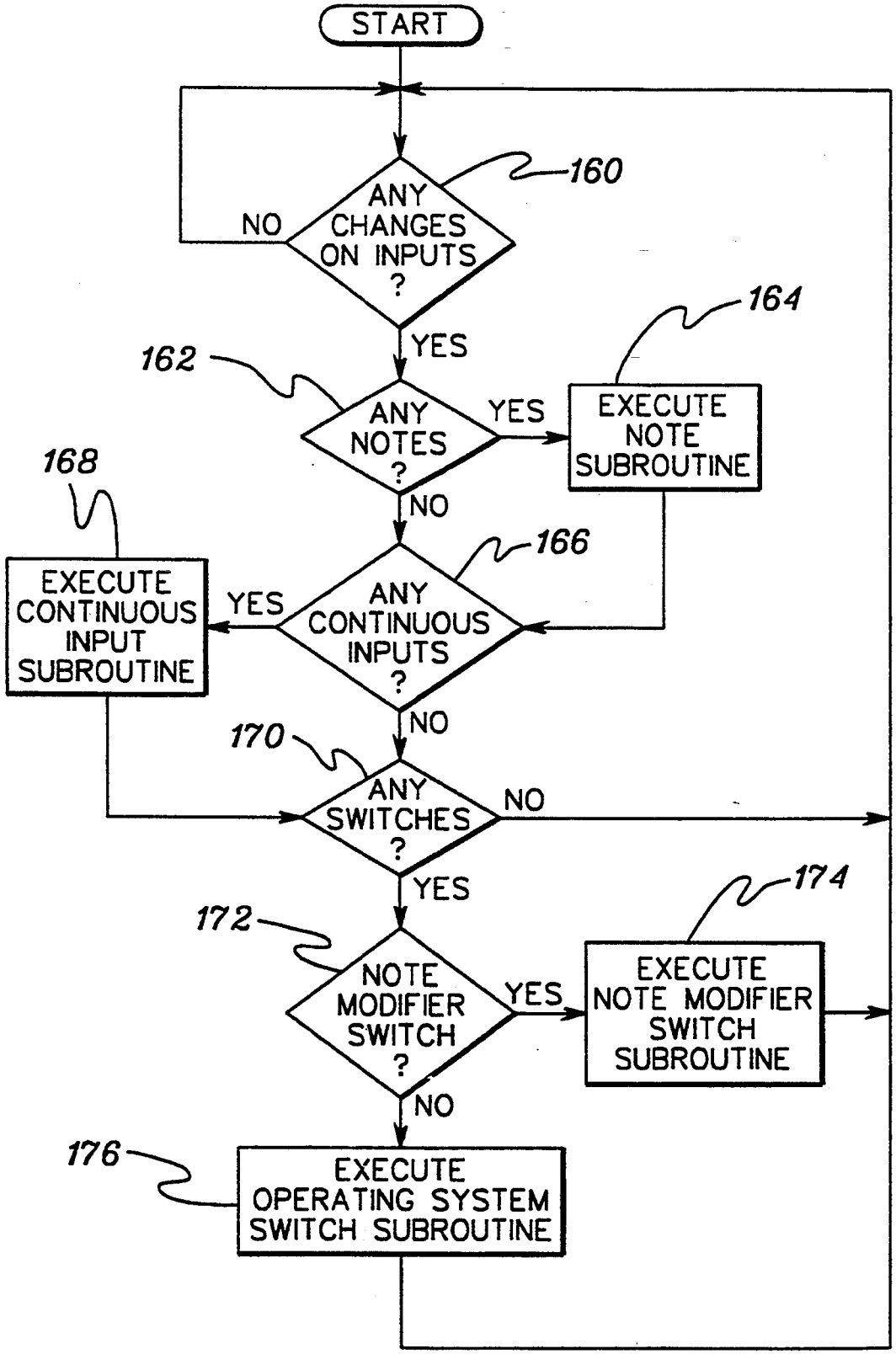
FIG. 5 comprises a flowchart of the main program of the scanner of the MIDI controller.

The main routine of the scanner is shown in FIG. 5. The scanner sequentially checks each input for a change of state (Query 160). If no change was recognized, the routine loops back and checks again. If any notes changed state (Query 162), the main routine calls the note subroutine (164) which generates the appropriate note event(s), writes the event(s) to the Event Compiler (58), and then returns to the main routine. If any continuous inputs changed (Query 166), e.g. a knob was turned, the main routine calls the continuous input subroutine (168) which generates the appropriate event(s), writes the event(s) to the Event Compiler, and then returns to the main routine. If any switch inputs changed (Query 170), e.g. a switch went from open to close, the main routine then determines the function of the switch (172) based on the memory mapped address of the switch input. For switches that are used to formulate MIDI commands, the main routine calls the note modifier subroutine (174). In this subroutine, the appropriate events are generated, written to the Event Compiler (58), then operation is returned to the main routine. Examples of note modifier events include manually entered Timbre Change event, MIDI Switch Controller event, etc. For all other switches, the main routine calls the operating system switch subroutine (176). Such subroutines may record edited data into memory, change the contents of various displays, change an input's sensitivity, etc. These are functions that do not generate MIDI commands, and relate to the operating and programming of the apparatus. The main routine then loops back to the beginning.

Referring again to FIG. 4, another function of the scanner (54) is to edit the contents of Element Memory (60). Here, the scanner reads from and writes to Element Memory based on switch inputs (52).

An Element is a piece of data used to configure software switches, filters and operators in a Processor (62) of the MIDI controller. The Elements are stored in Element Memory (60). A complete set of elements comprises a Master Program. A plurality of Master Programs reside in Element Memory.

An operator is a software configured portion of Processor 62 which acts on incoming data to produce the desired output data. For example, a transpose operator adds 12 to the key number to shift up twelve semitones.

Figure 6:
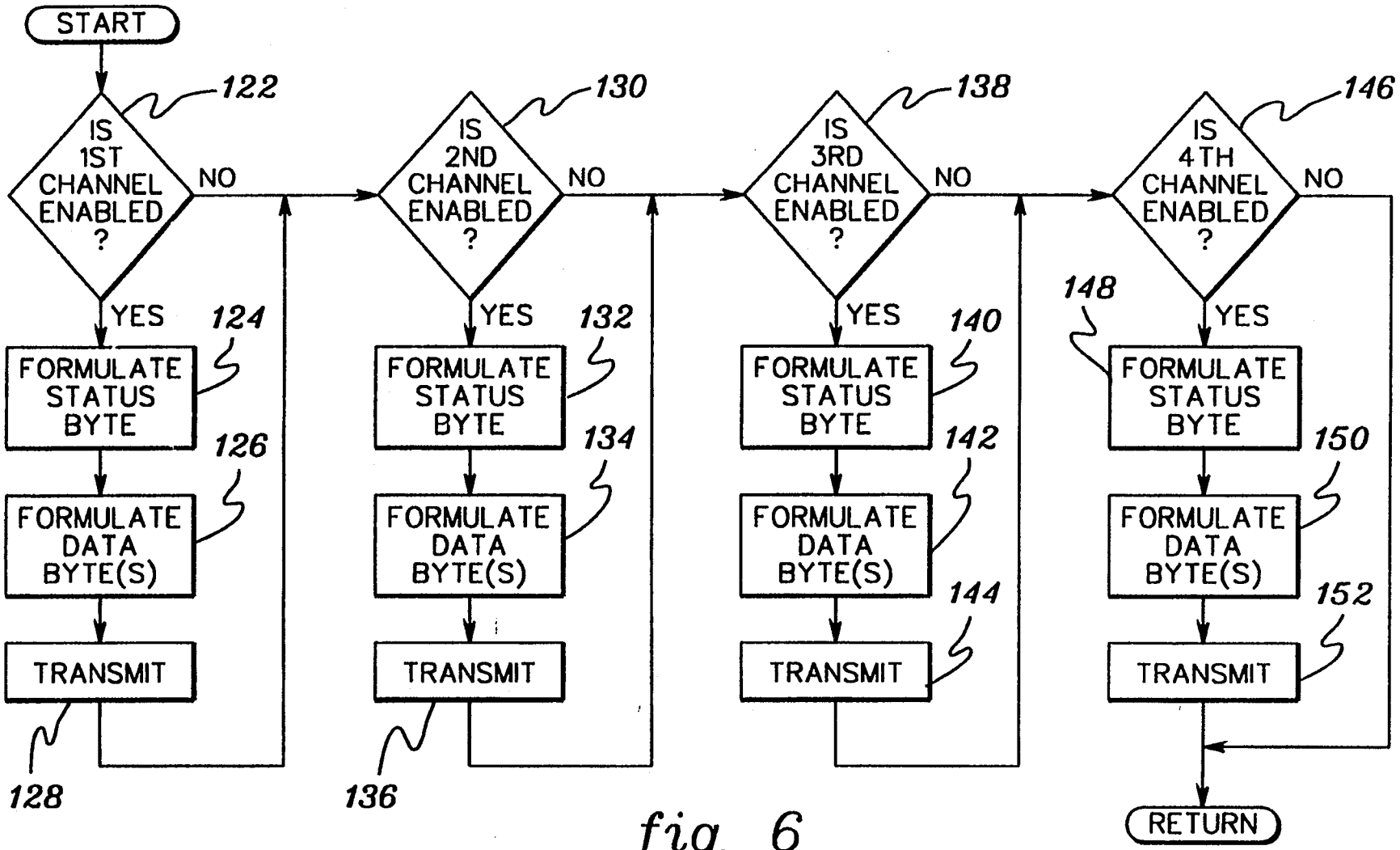
FIG. 6 presents a basic flowchart of all subroutines in the processor of the MIDI controller.

Processor (62) implements a series of subroutines which convert Events into MIDI commands. All of the subroutines have the same basic format as illustrated in FIG. 6.

The Processor retrieves the next Event from the Event Compiler (58). Processor (62) then executes the subroutine that corresponds to that Event. As shown in FIG. 6, initially the Processor checks if the first channel is enabled (Query 122). If disabled, operation skips to the next channel (Query 130). If the first channel is enabled, the Processor formulates the appropriate MIDI status byte (124), and all necessary MIDI data bytes (126), and then transmits the MIDI command (128) out of the MIDI OUT port. Operation then continues to the next channel (130). If the second channel is enabled (130), the appropriate MIDI status byte (132) and MIDI data bytes (134) are formulated and the MIDI command is transmitted (136). This procedure is repeated for the third and fourth channels as illustrated in the flow chart. The Processor can be implemented with a microcontroller, ROM, RAM and serial port, as is well known in the art. Conventional operation of the MIDI controller will now be described, with general reference to FIGS. 3 & 4.

To change the timbre(s) on the MIDI sound generators connected to the MIDI controller (51), the musician presses the appropriate switch(es). The scanner (54) recognizes the switch(es) and writes a Timbre Change Event onto the Event Compiler (58). The Processor (62) then transmits the appropriate MIDI Timbre Change (more commonly referred to as MIDI Program Change) command from the MIDI OUT port (66). The MIDI sound generators (24) receive the command through their respective MIDI IN ports (28), and retrieve the appropriate timbre from timbral memory (32). All subsequent notes played will have this new timbre.

The MIDI controller (51) is also capable of changing the volume levels of the MIDI sound generators connected to it. When the musician presses the appropriate switch(es) and/or changes the position of the appropriate continuous inputs, the scanner (54) generates the Volume Event and writes it to the Event Compiler (58). The Processor (62) then converts this event into the appropriate MIDI volume change commands which are transmitted from the MIDI OUT port (66). This command is used by the MIDI Sound Generators to determine the volume of all notes.

Whenever the musician plays a note on the keyboard (56), the scanner (54) determines which key was played, i.e. key number, then determines the key speed. With these two pieces of information, the scanner generates the Note On Event and writes it to the Event Compiler (58). The Processor (62) then converts this event into the appropriate MIDI Note On commands which are transmitted from the MIDI OUT port (66). This command is used by the MIDI Sound Generators to play notes.

The MIDI Note On command consists of a status byte and two data bytes. The first data byte is the note number from 0 to 127. This byte is used by the MIDI sound generators to determine the pitch of the note. The second data byte is the velocity amount. The MIDI sound generators use this byte to determine the dynamic response of the note.

One method of formulating the note number data byte is to use the key number as a base address. For example, the lowest key on the keyboard would have key number=0, the next key up from the lowest key would have key number=1, etc. The MIDI note number can then be computed by adding a transpose offset to the key number.

One method of formulating the velocity data byte is to use the key speed as an index into a look-up table. The dynamic response can be changed by changing look-up table index.

The presently preferred embodiment of the inventive apparatus is capable of producing four MIDI Note On commands for each Note On Event. The Processor uses Key Speed from the Event Compiler as an index into a look-up table that translates into MIDI Note Velocity values. The preferred embodiment has 32 entries in the look-up table in memory.

In accordance with the present invention, a Randomizer 64, is incorporated into MIDI controller 51 in order to facilitate the generation of new Total Sounds. This Randomizer takes into account what is believed to be the most important elements in the construction of new Total Sounds, these being timbre, pitch, volume and dynamic response, and assigns random (yet intelligible) values to these elements to create new and unique sounds that otherwise might not be possible.

The randomizer function performs a form of high level additive synthesis, where entire timbres (waveforms & modifiers) are uniquely combined to create new sounds. This is fulfilled through the MIDI standard protocol.

In addition to means to automatically randomly develop timbral combinations, the Randomizer includes means to select which elements are randomized, and a means to manually edit these and other elements to produce the desired Total Sound. The specifics of Randomizer implementation and operation will now be described.

Figure 7A:
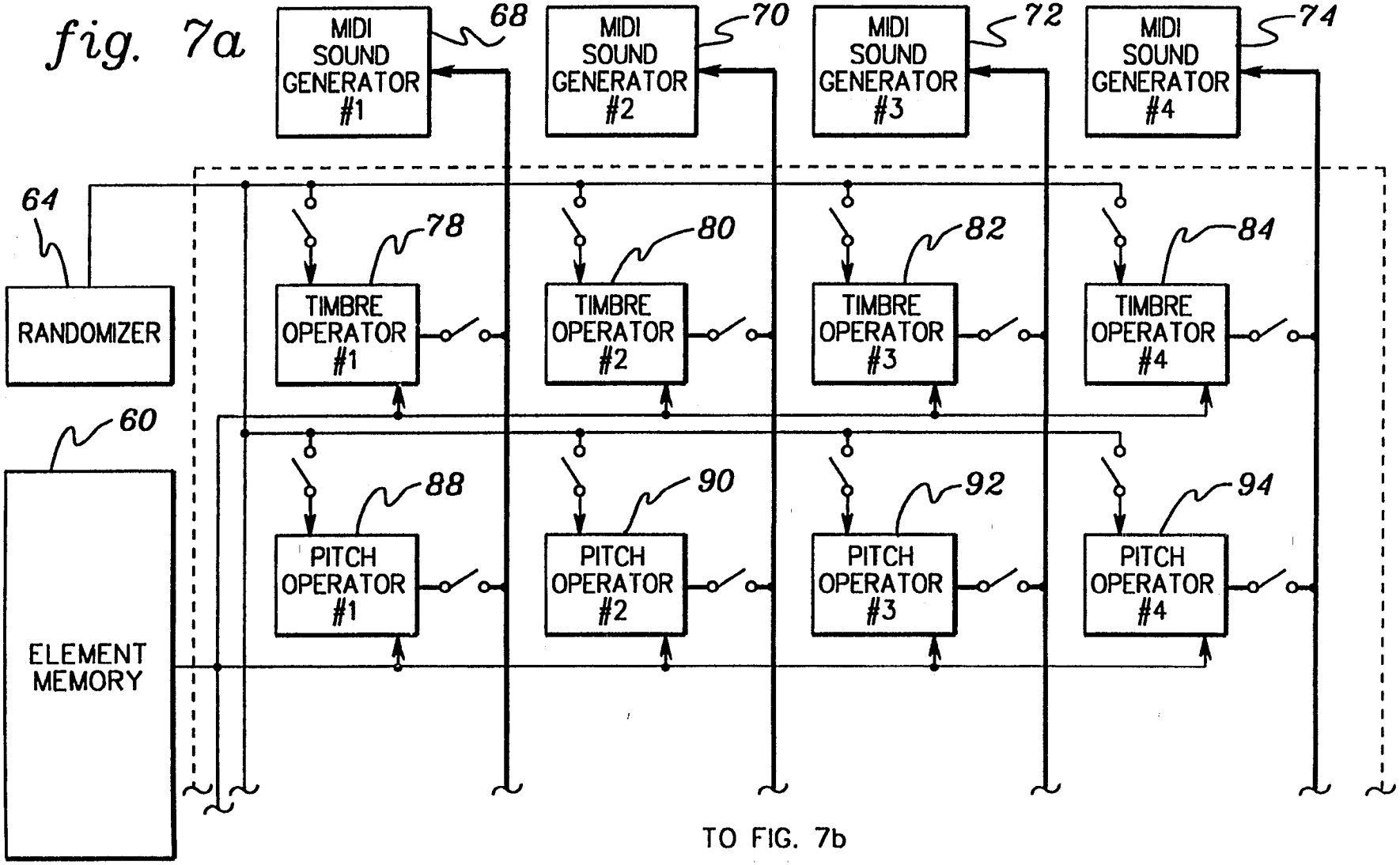
FIG. 7 is a functional block diagram illustrating how the randomizer operates.
Figure 7B:
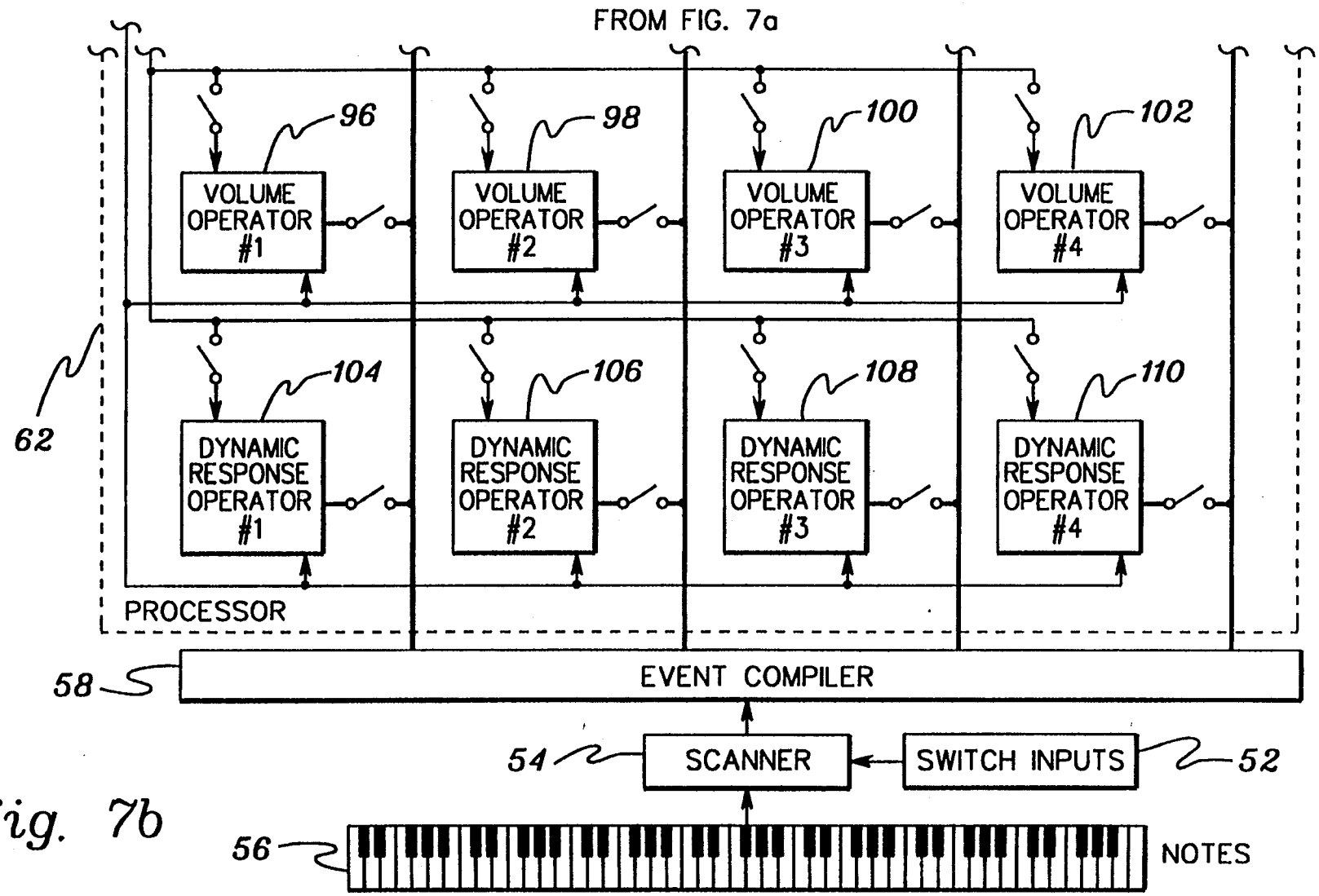

To perform the Randomizer function, a Randomizer (64) is added to MIDI controller (51) of FIG. 4. The Randomizer is configured by the musician through switch inputs (52). Configuring the Randomizer basically means determining which elements to randomize and which to leave unaffected. The operation of the Randomizer is shown in greater detail in FIG. 7.

The Element Memory (60) configures the sixteen operators shown (78–84, 88–110). The notes from keyboard (56) and switch inputs (52) are scanned by the scanner (54) and the appropriate Events are written to the Event Compiler (58).

As an Event passes through the Processor (62), those operators needed for the particular event are switched in, and the event is converted into the appropriate MIDI commands by the operators, and then sent to the MIDI sound generators (68–74).

The musician individually selects which elements are to be randomized by effectively closing the switch that connects the appropriate operator to the Randomizer (64).

In the preferred embodiment with four channels, and each channel possessing 128 possible timbre numbers, 4 possible transpositions, 128 possible volume levels and 32 possible velocity responses, there would be $7.5*10^{22}$ possible combinations. It would take billions of years to generate all possible combinations. By sampling uncorrelated timbral combinations, the musician is subjected to a broader cross-section of possible combinations and, by changing the configuration of the Randomizer, can focus the field of timbral combinations toward the desired sound.

At the core of the Randomizer (64), is a Random Number Generator which preferably produces a 16-bit integer sequence X(n) based on the following formula:

Random Number Generator $X(1)=9$
$X(2)=11*\text{remainder of } (9/179)=11*9=99$
$X(3)=11*\text{remainder of } (99/179)=11*99=1089$
$X(4)=11*\text{remainder of } (1089/179)=11*15=165$
$X(n)=11*\text{remainder of } [X(n-1)/179]$ where:

X(n) is a 16-bit number

X(1) refers to the first number in the sequence.

X(2) is the second number in the sequence. X(n) is the nth number and X(n+1) is the next number after X(n). The term "remainder of [X(n−1)/1791]" can also be written X(n−1)mod (179) and means the integer remainder that is leftover when the number X(n−1) is divided by 179.

X(n) is buffered in non-volatile memory so the random sequence is not interrupted when the system is rebooted. This pseudorandom sequence repeats after every 178 numbers are generated. There are a variety of methods available to generate pseudorandom sequences. Suitable software routines for this purpose are available and/or may be readily created by those skilled in the relevant art.

The random number generator described above produces 16-bit integers. When used by the timbre number operator, the random number is truncated to 7-bits or 3-bits. When used by the transpose operator, the random number is truncated to 2-bits. When used by the velocity operator, the random number is truncated to 5-bits. When used by the volume operator, the random number is truncated to 6-bits or 7-bits. The purpose of these different truncations are described hereinafter. Even though the random number generator produces a sequence that repeats every 178 numbers that are generated, the random number is further altered by truncation to produce even more random results.

FOUR KEY ELEMENTS OF TIMBRAL COMBINATIONS

Manipulating the four key elements of a timbral combination will produce a new Total Sound.

1. Timbre

Changing the timbre through MIDI is accomplished via the MIDI Timbre Change command. When a MIDI Sound Generator (24) recognizes this command, it activates the timbre associated with the Timbre Number embedded in the command. Up to 128 timbre numbers (0–127) are supported by this command; additional timbre numbers can be accessed through the MIDI bank select command.

The musician has two options when randomizing timbres. The first option allows all 128 timbre numbers to be available, which means one timbre between 0–127 will be chosen at random. Since the timbre number field is as wide as possible, this gives the musician the widest variance in timbral combinations which may be used as a source of new sounds. The second option allows the musician to choose any seven timbre numbers. The randomizer (64) then randomly chooses one of these seven timbres. Since the field is limited, the timbral combinations are focused in a certain direction. This is useful when the musician has a general idea of what type of sound is desired.

Figure 8A:
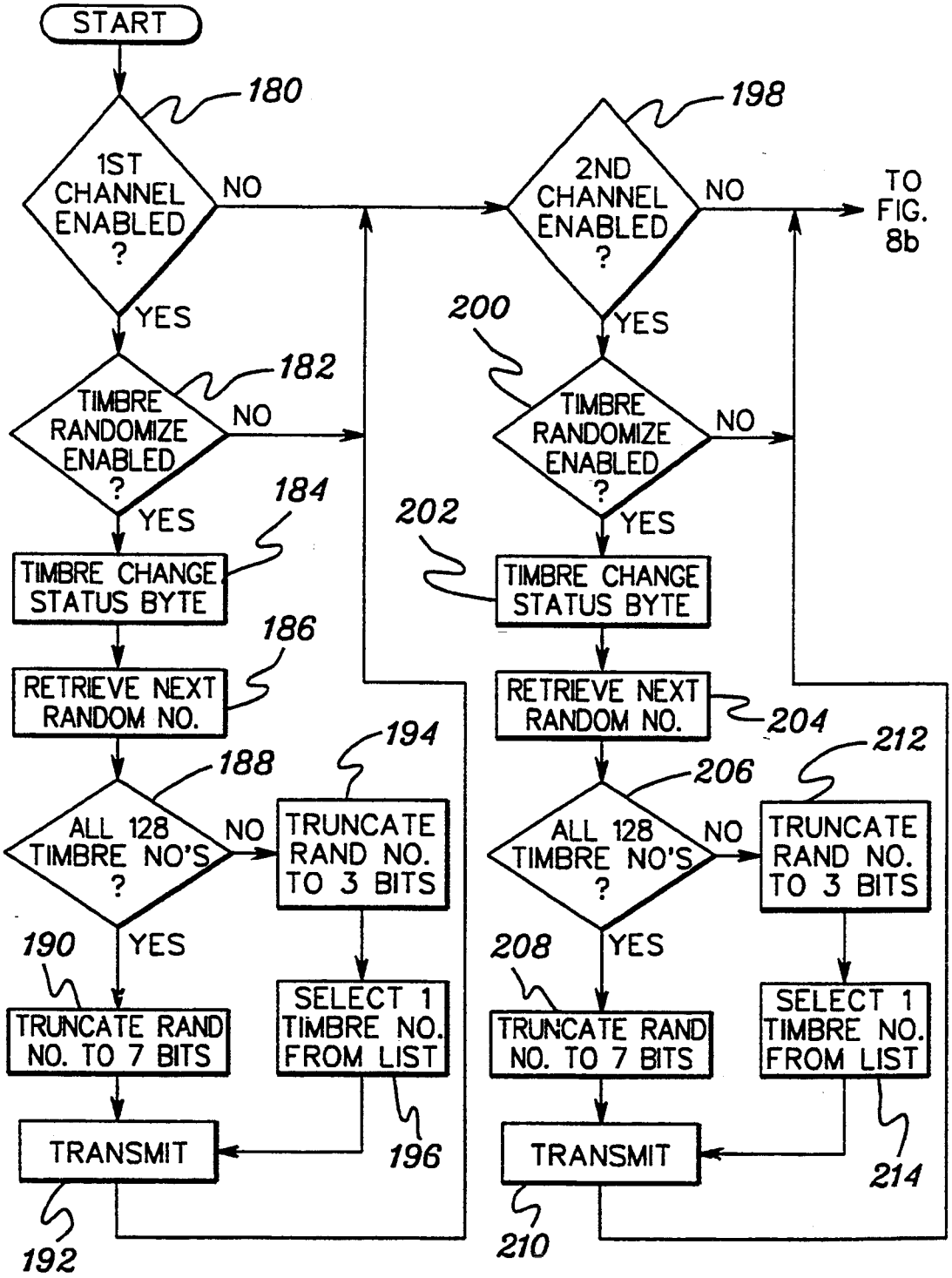
FIG. 8 is a flowchart illustrating a processor subroutine for a Timbre Change Event.
Figure 8B:
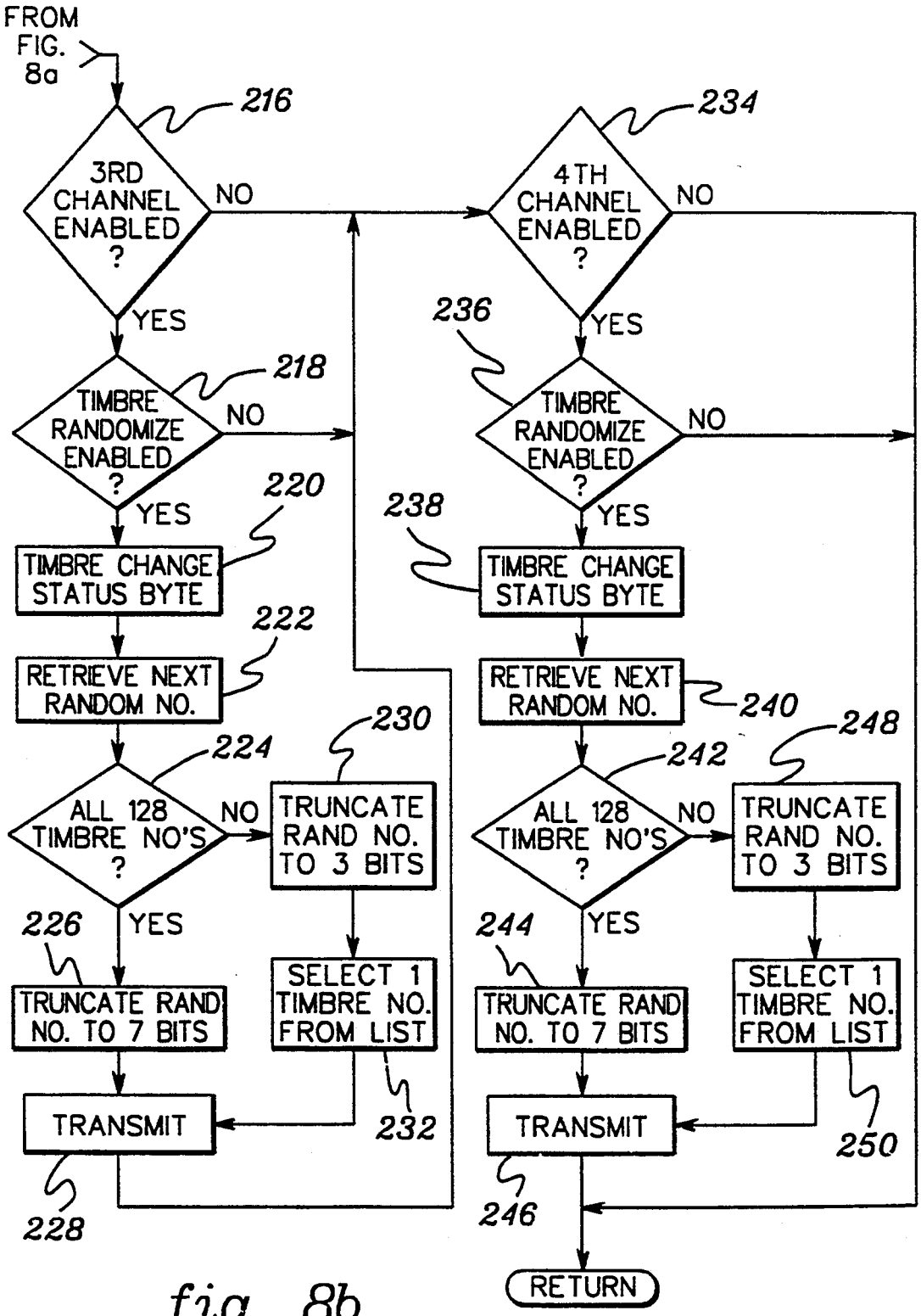

FIG. 8 shows a flowchart of the processor subroutine that handles the timbre change event. When the Processor (62) retrieves a timbre change event from the Event Compiler (58), it calls this subroutine. The Processor checks if the first channel is enabled (Query 180). If disabled, operation skips to the next channel (198). If the first channel is enabled, the subroutine determines whether timbres for this channel are to be randomized (Query 182). If not, operation skips to the next channel (198). If this element is to be randomized on the first channel, the Timbre Change Status Byte is formulated (184). The next random number is retrieved (186). If the musician selected (Query 188) all 128 possible timbre numbers, the random number is truncated to 7 bits (190) and the two-byte MIDI Timbre Change command is transmitted (192) where the timbre number is a random number from 0–127. Otherwise, the subroutine truncates the random number to 3 bits (194) and uses this to point into the list of 7 timbres to select one at random (196). The two-byte MIDI Timbre Change command is then transmitted.

The subroutine then moves to the second channel (198). This procedure continues for the second channel (198–214), third channel (216–232) and the fourth channel (234–250) before returning to the main program.

2. Volume

The dynamics of the Total Sound are characterized by the relative volume of the overall sound in the context of the music, and the relative volumes of the component timbres. MIDI can be used to control the Total Sound's volume and the volumes of each timbre through the MIDI Volume control command.

Figure 9A:
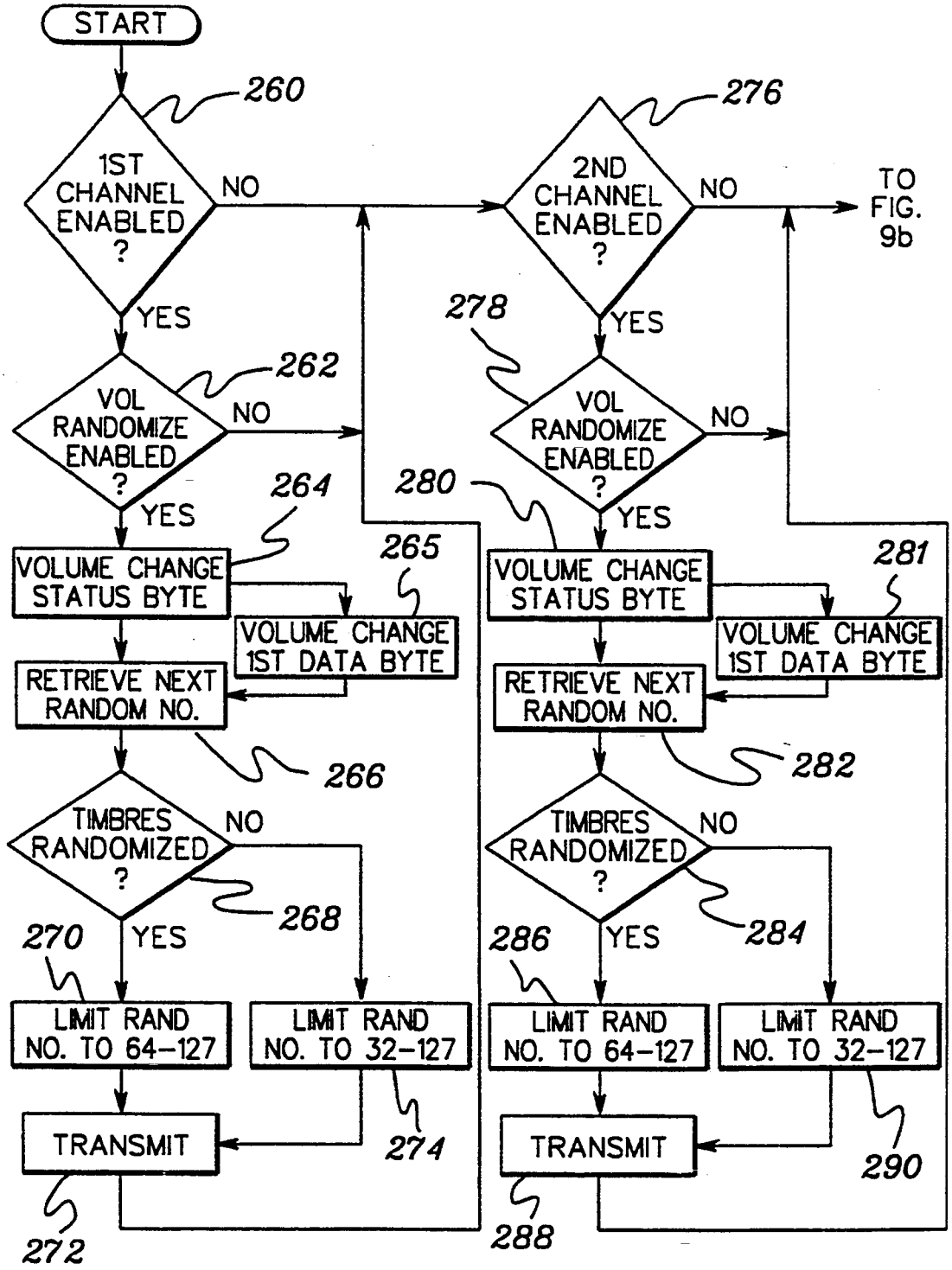
FIG. 9 depicts, in flowchart form, a processor subroutine for a Volume Change Event.
Figure 9B:
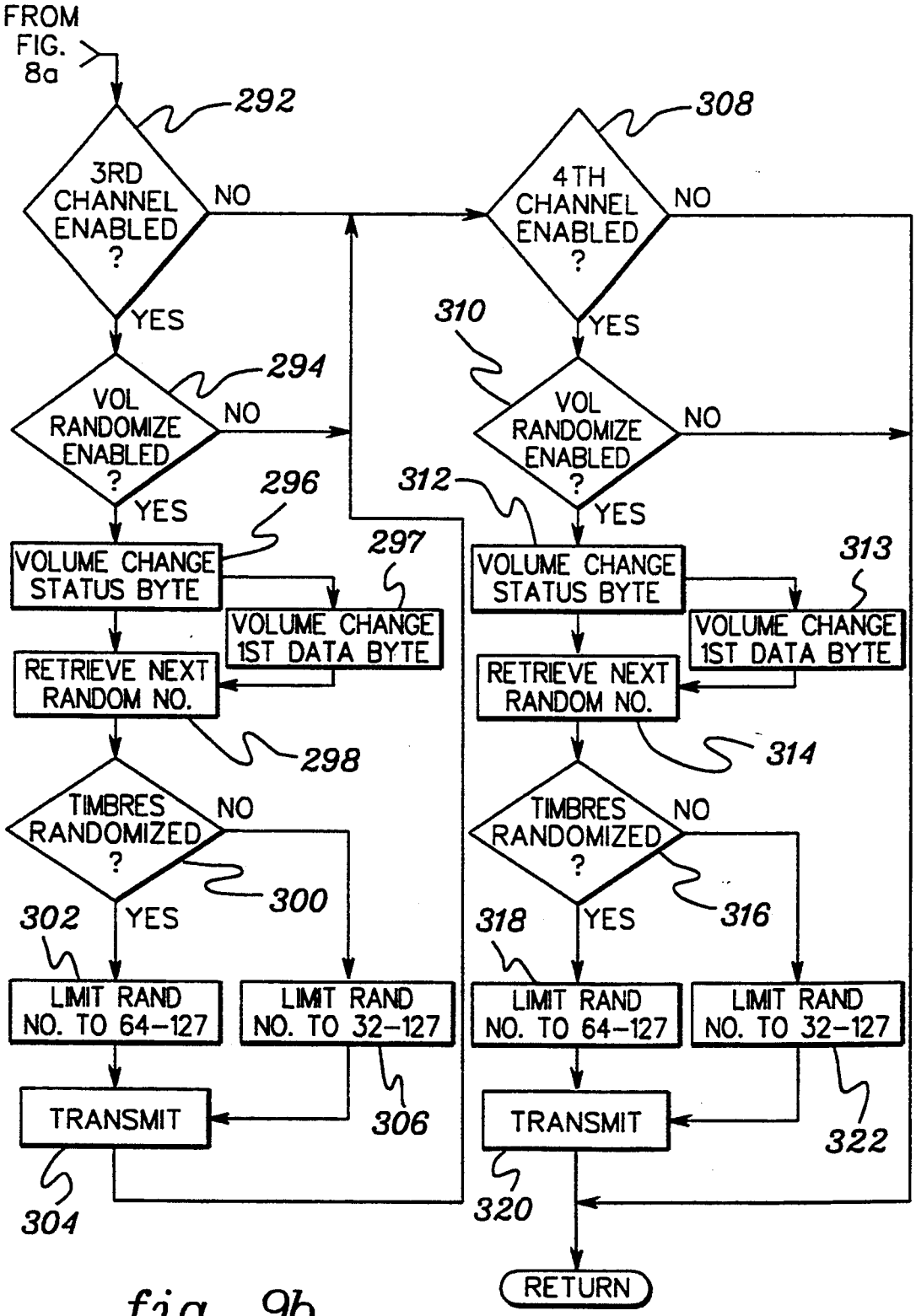

FIG. 9 shows a flowchart of the processor subroutine that handles the volume change event. When the Processor (62) retrieves a volume change event from the Event Compiler (58), it calls this subroutine. The Processor checks if the first channel is enabled (Query 260). If disabled, operation skips to the next channel (276). If the first channel is enabled, the subroutine determines whether this element for this channel is to be randomized (Query 262). If not, operation skips to the next channel (276). If this element is to be randomized on the first channel, the Volume Change Status Byte is formulated (264) and the first of two Volume Change Data bytes is formulated (265). The next random number is retrieved (266). If timbres are being randomized on this channel (Query 268), the random number is rounded off to a number between 64–127 (270) and the three-byte MIDI Volume Change command is transmitted (272). Otherwise, the random number is rounded off to a number between 32–127 (274) then transmitted (272).

The subroutine then moves to the second channel (276). This procedure continues for the second channel (276–290), third channel (292–306) and the fourth channel (308–320) before returning to the main program.

In the presently preferred embodiment, there are two volume ranges: 1) Limited range between 64–127 and 2) Wide range between 32–127. If timbres are being randomized, the volume levels will be close enough to hear all timbres but varied enough to make a noticeable difference in the overall sound. When timbres are not changing, the volumes can vary over a wider range for even greater differences in overall sound.

3. Pitch

The relative pitch of each component timbre affects the quality of the Total Sound. In MIDI, this can be controlled through the MIDI Note On command, by independently specifying the note number of each timbre for a given Total Sound note.

Figure 10:
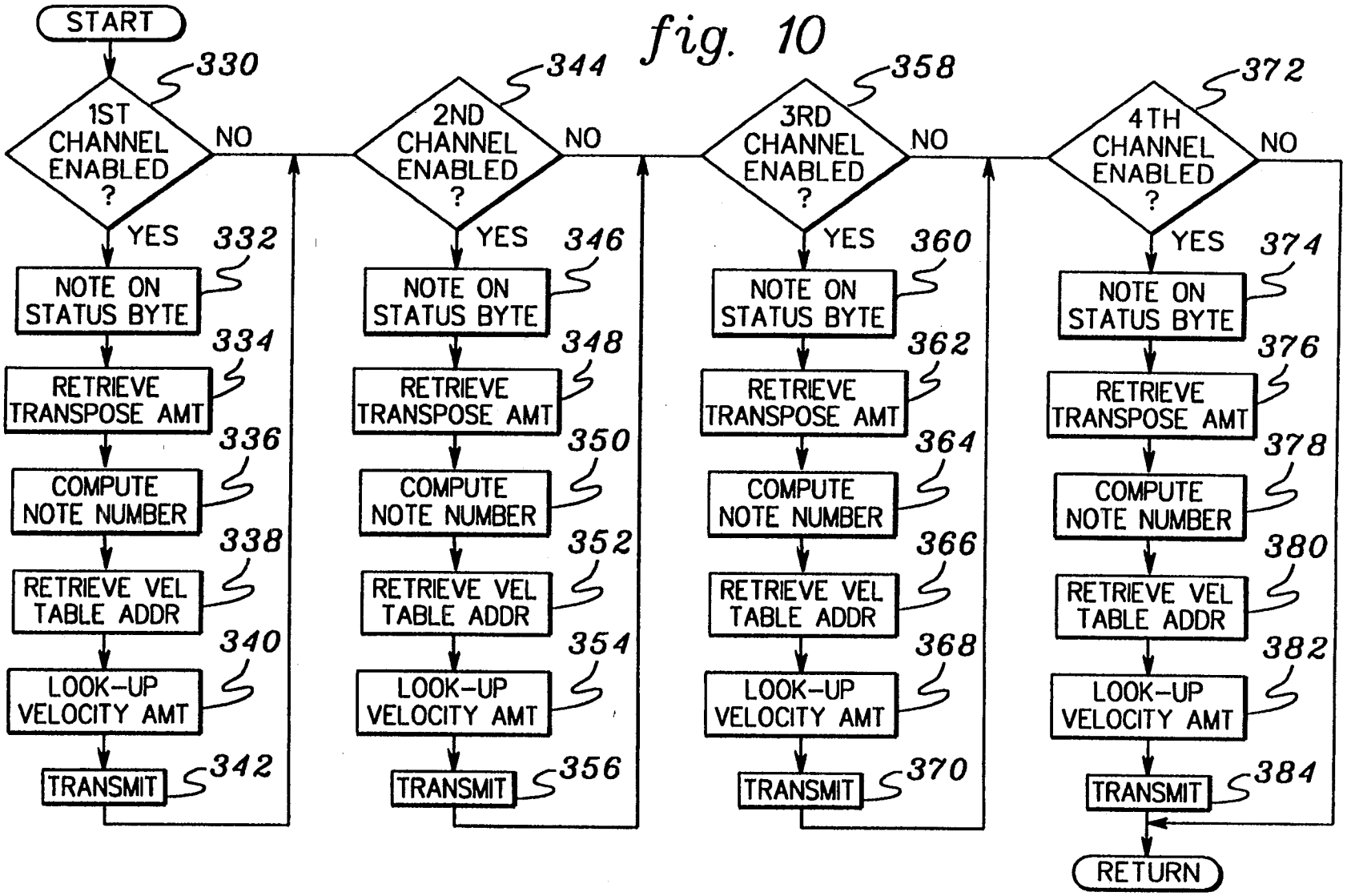
FIG. 10 is a flowchart illustrating a processor subroutine for a Note On Event.

FIG. 10 illustrates how the MIDI Note On commands are generated. When the Processor (62) retrieves a Note On event from the Event Compiler (58), it calls this subroutine. The Processor initially checks if the first channel is enabled (Query 330). If disabled, operation skips to the next channel (344). If the first channel is enabled, the Processor formulates the MIDI Note On status byte (332). The Processor then retrieves the transpose amount (334) and computes the MIDI note number (336) by adding the transpose amount to the key number. The Processor then retrieves the velocity table address for the desired velocity response (338) and gets the velocity amount from the appropriate look-up table (340). The three-byte MIDI note on command is transmitted (342).

The subroutine then moves to the second channel (344). This procedure continues for the second channel (344–356), third channel (358–370) and the fourth channel (372–384) before returning the main program.

The randomizer changes the pitch by changing the transpose amount (of steps 334, 348, 362, 376). The randomizer has four possible transpose amounts, i.e. down one octave, no transpose, up one octave and up two octaves. The randomizer controls the pitch of the MIDI sound generators by offsetting the note number in the MIDI Note On command. The key number listed in the Event buffer is offset by a transpose amount.

Figure 11:
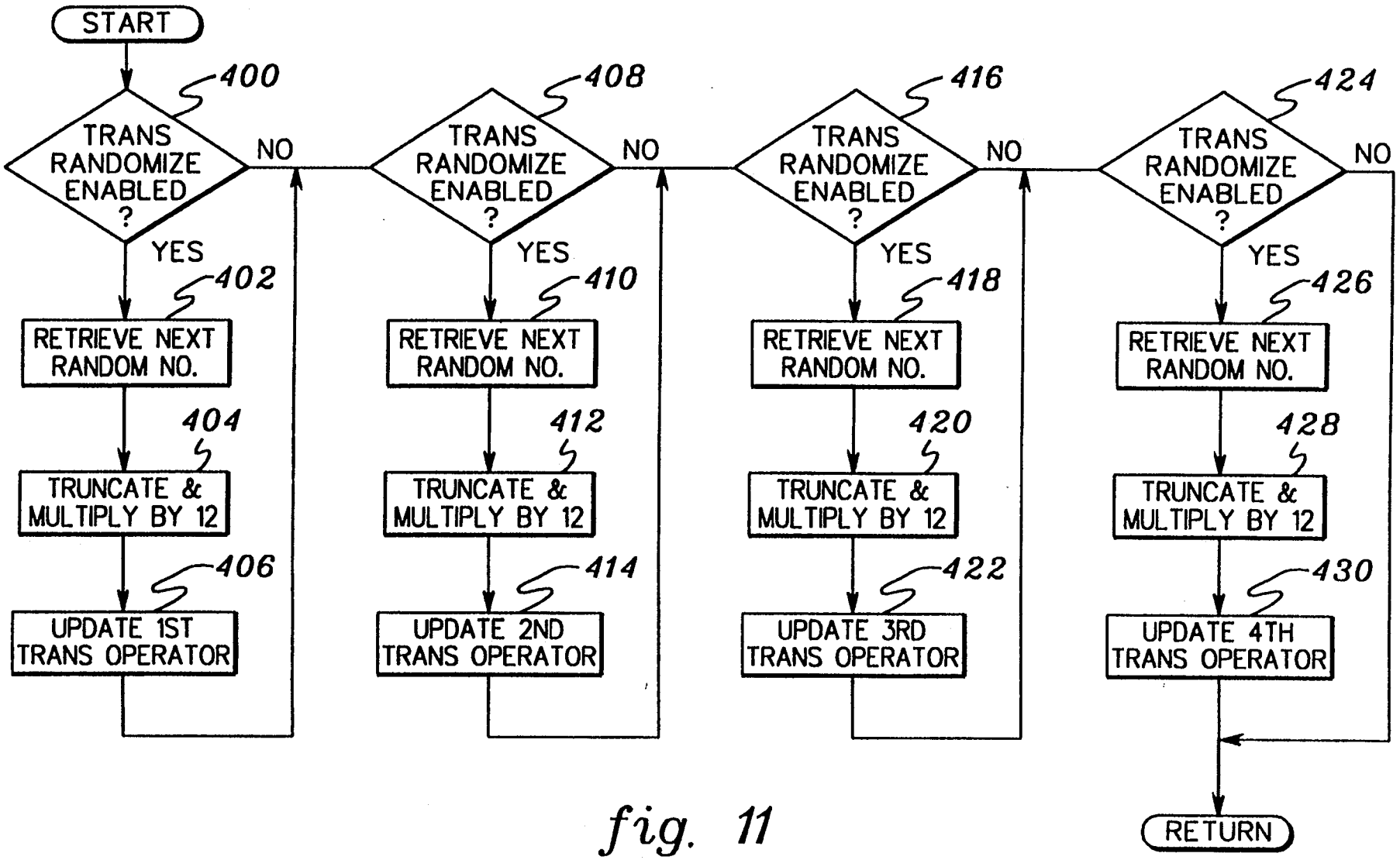
FIG. 11 depicts, in flowchart form, a randomizer subroutine which randomizes pitch through the transposition.

The method used to change transpose amounts is illustrated in FIG. 11. When the Randomizer is activated, this subroutine is executed. If transpose amounts are enabled to be randomized on the first channel (Query 400), the Processor retrieves the next random number (402). This number is truncated to a 2-bit number then multiplied by 12 (404) to produce the transpose amount. The Transpose operator (88) of the first channel is updated with this new amount. The subroutine then continues to the second channel (408–414), third channel (41614 422) and the fourth channel (424–430).

4. Dynamics

MIDI can be used to control the Total Sound's dynamics through the MIDI Note On command, i.e. through the velocity portion of the command. The key speed is used as an index into a look-up table to retrieve the appropriate velocity amount. The preferred embodiment of this invention has 32 different velocity entries in the look-up table.

Figure 12:
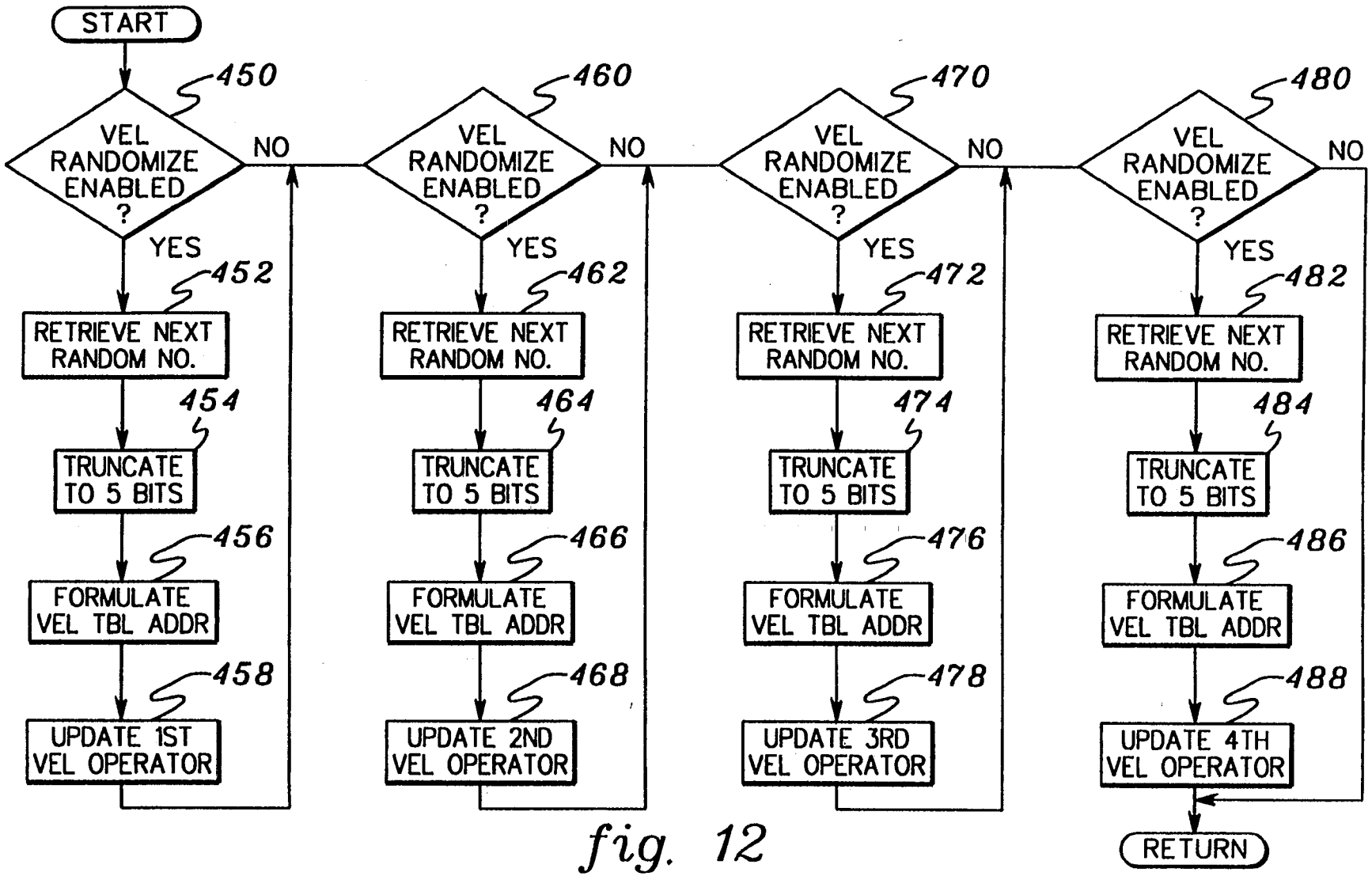
FIG. 12 is a flowchart of a randomizer subroutine which randomizes dynamic response through the velocity amount.

Changing the dynamic response of a timbre is implemented by changing the address to different velocity look-up tables. Indexing into look-up tables is a common method used in the field. FIG. 12 illustrates how the Randomizer changes the look-up table addresses. When the randomize function is activated, this subroutine is executed. The Processor determines whether or not velocity is to be randomized on the first channel (Query 450). If disabled, operation skips to the next channel (460). If the first channel is enabled, the next random number is retrieved (452) and truncated to 5 bits (454). The velocity table address is then formulated (456) and the velocity operator (104) of the first channel is updated with the new address.

The subroutine then continues in like manner for the second, third and fourth channels.

Examples of how the MIDI Controller with Randomizer might be used to create new Total Sounds will now be presented.

A musician would first choose how many MIDI sound generators (24) he would like to audition. Next he would choose which particular sound elements he wants to randomly combine as in FIG. 7 from each MIDI sound generator. These elements are timbre (78–84), Pitch (88–94), Volume (96–102) and Dynamic Response (104–110). The musician would then proceed to have the Randomizer (64) create random timbral combinations by randomly operating on the selected elements. He would then begin to hear timbral combinations with qualities unlike what each individual MIDI sound generator is capable of producing by itself. As he is sampling these timbral combinations, the musician has the ability to record and save any timbral combination produced by the Randomizer for use as is or for further refinement. For example he may discover a unique sound layer that has just the right timbre and pitch elements but would like to hear more volume and dynamic response variations than the Randomizer produced. At that point he could selectively eliminate timbre and pitch from being randomized. These elements would stay the same while variations were made with volume and dynamic response allowing the musician a more directed approach to his final timbral combination.

Suppose a musician is looking for a new and unique string section sound for his latest project. He would select the appropriate MIDI sound generators (24) then select string sounds from each. Then he would begin to audition Total Sound "snap shots", i.e. sound samplings, produced by the random combination of the elements: timbre, pitch, volume and dynamic response. As he hears these timbral combinations, he can record to memory those that fit his purpose. The configuration is directed by the original limiting of only string sounds to be combined from the MIDI sound generators.

From the foregoing description, it will be evident that a new and improved MIDI Controller has been developed which facilitates production of new Total Sounds. With the Randomizer function of the present invention, the musician can guide the creation of desired new sounds, unfettered by the technology. The prior art inhibitions on the musician's creativity are thus alleviated.

Although a preferred embodiment has been described in detail and depicted herein, it will be apparent to those skilled in this art that various modifications, substitutions, enhancements and other variations can be made without departing from the spirit of this invention. For example, the Randomizer function can be implemented in other MIDI sources and, accordingly, the term "MIDI Controller" should be construed as encompassing all MIDI data sources. In certain applications, it may be desirable to limit the transpose operator to one or two or some other number of octaves, or to transpose to 7th's or 5th's, etc. Similarly, velocity may be limited to a different number of indexes or look-up tables. The number of MIDI channels and/or MIDI sound generators can also vary. If the number of MIDI sound generators exceeds the number of MIDI channels of the MIDI controller, MIDI channel number could be considered a fifth element which could be randomized pursuant to the principles of the present invention. These and all other variations which fall within the true spirit of this invention are intended to be encompassed within the scope of the claims appended hereto.

What is claimed is:

1. In a MIDI Controller which produces MIDI commands for controlling sound generation by one or more MIDI sound generators from note inputs and switch inputs, the improvement comprising:

randomizer means selectively connected to said one or more MIDI sound generators and reponsive to said note inputs and switch inputs for randomizing timbre and one or more of the following sound elements of a MIDI command produced by said MIDI controller: pitch, volume and dynamic response.

2. The improved MIDI Controller of claim 1 wherein the randomizer means includes means for selectively randomizing timbre, pitch, volume and dynamic response along one or more MIDI channels.

3. The improved MIDI Contoller of claim 1 further including means for selectively guiding element randomization.

4. The improved MIDI Controller of claim 1 wherein the randomizer means comprises a random number generator and means for selectively truncating an output of said random number generator.

5. A MIDI Controller for controlling the total sound produced by a plurality of MIDI sound generators connected to and controlled by the MIDI Controller, comprising:

note input means for providing note inputs;

switch input means for providing switch inputs;

element memory means for storing a plurality of master programs;

a sound change event command buffer for storing event commands;

scanner means for generating the event commands based on contents of the element memory upon occurrence of changes in the note inputs and switch inputs, the scanner means writing the event commands to the event buffer;

processor means for reading event commands from the event buffer and converting the event commands into MIDI commands; and randomizer means coupled to said processor for facilitating selective randomization of timbre and at least one of the following elements: pitch, volume and dynamic response.

6. An electronic sound designing system for designing and generating an audible total sound comprising a plurality of composite sounds, said electronic sound designing system operating in accordance with conventional Musical Instrument Digital Interface (MIDI) standards, comprising:

a sound generation system for generating said designed audible total sound from said plurality of composite sounds;

a plurality of sound signal generators, each said sound signal generator generating a signal representing one of said plurality of composite sounds, each of said plurality of composite sounds having a particular timbre and a plurality of sound elements; and a user-activated randomizer coupled to said plurality of sound signal generators for randomly selecting a random timbre from a plurality of possible timbres.

7. The electronic sound designing system of claim 6 wherein said user-activated randomizer randomly further selects one or more random sound elements from a plurality of possible sound elements.

8. The electronic sound designing system of claim 6 further comprising a data source for generating data representing said particular timbre and said plurality of sound elements.

9. The electronic sound designing system of claim 8 wherein said data source is a controller comprising:

means for inputting data defining said particular timbre and said plurality of sound elements;

a scanner for monitoring for a change in said data and for generating an event based on said change; and a processor for converting said event into a total sound command.

10. The electronic sound designing system of claim 9 wherein said data inputting means comprises:

means for inputting a plurality of continuous analog sound modifiers and an associated analog-to-digital converter therefor;

means for inputting a plurality of switch sound modifiers, wherein said switch sound modifiers determine what will be randomized among said plurality of timbres and sound elements; and means for inputting a plurality of musical note inputs.

11. The electronic sound designing system of claim 9 further comprising an event buffer between said scanner and said processor.

12. The electronic sound designing system of claim 9 further comprising a memory means from which said scanner reads to generate said event.

13. The electronic sound designing system of claim 10 wherein said musical note inputting means comprises a key board.

14. The electronic sound designing system of claim 6 wherein said plurality of sound elements includes pitch.

15. The electronic sound designing system of claim 6 wherein said plurality of sound elements includes volume.

16. The electronic sound designing system of claim 6 wherein said plurality of sound elements includes dynamic response.

17. The electronic sound designing system of claim 8 wherein said data source generates data representing pitch.

18. The electronic sound designing system of claim 8 wherein said data source generates data representing volume.

19. The electronic sound designing system of claim 8 wherein said data source generates data representing dynamic response.

20. The electronic sound designing system of claim 9 wherein said scanner writes to said memory means based on said data from said data inputting means.

21. The electronic sound designing system of claim 10 wherein said means for inputting a plurality of continuous analog sound modifiers comprises a volume modifier.

22. The electronic sound designing system of claim 6 wherein said user-activated randomizer comprises:

a random number generator for generating a random number; and means for truncating said random number to a preselected number of digits, wherein said truncated random number identifies said random timbre.

23. The electronic sound designing system of claim 7 wherein said user-activated randomizer comprises:

a random number generator for generating a random number; and means for truncating said random number to a preselected number of digits, wherein said truncated random number identifies one of said random timbre and said one or more random sound elements.

24. A method of designing an audible total sound on an electronic sound designing system, said total sound comprising a plurality of composite sounds, each of said plurality of composite sounds comprising a plurality of sound elements including timbre, pitch and dynamic response, each of said plurality of sound elements having a plurality of variations, said electronic sound designing system comprising a sound generator associated with each of said plurality of composite sounds, a plurality of note inputs, a randomizer for randomizing one or more of said plurality of sound elements comprising a given composite sound, a memory for storing information representing said plurality of variations of said plurality of sound elements, said electronic sound designing system operating in accordance with conventional Musical Instrument Digital Interface (MIDI) standards, said method comprising:

activating a sound generator;

activating said randomizer to randomly choose a sound element variation of at least one of said plurality of sound elements comprising said composite sound associated with said activated sound generator;

inputting one of said plurality of note inputs, whereby a total sound including said at least one randomized sound element is produced; and generating to said total sound.

25. The method of claim 24 wherein said electronic sound designing system further comprises a random number generator and a number truncator, and wherein said step of activating said randomizer comprises:

generating a 16 bit random number; and truncating said 16 bit random number based on which of said plurality of elements is randomized.

26. The method of claim 25, wherein timbre is randomized, said step of truncating comprising truncating said 16 bit random number to a 7 bit random number indicating one of 128 possible timbres.

27. The method of claim 25, wherein timbre is randomized, said method further comprising the step of choosing a group of seven possible timbres out of 128 from which to randomize, said step of truncating comprising truncating said 16 bit random number to a 3 bit random number indicating one of said 7 possible timbres.

28. The method of claim 25, wherein volume is randomized, said step of truncating comprising truncating said 16 bit random number to a 7 bit random number representing one of a possible 128 volume levels excluding the lowest 32 where timbre is also randomized and truncating said 16 bit random number to a 6 bit random number representing one of a possible 128 volume levels excluding the lowest 64 where timbre is not randomized.

29. The method of claim 25, wherein pitch is randomized, said step of truncating comprising truncating said 16 bit random number to a 2 bit random number, multiplying said 2 bit random number by 12 (binary 1100) and adding the result to a number representing said one of said plurality of note inputs, thereby randomly altering said pitch by effectively moving down one octave, causing no change, moving up one octave or moving up two octaves.

30. The method of claim 25, wherein dynamic response is randomized, said step of truncating comprising truncating said 16 bit random number to a 5 bit random number representing one of 32 possible look-up table entries for dynamic response.

31. The method of claim 24, wherein said electronic sound designing system further comprises a memory for storing information representing one or more composite sounds, said method further comprising the step of storing said information representing said composite sound associated with said activated sound generator.

32. An electronic sound designing system for designing and generating an audible total sound comprising a plurality of composite sounds, said electronic sound designing system operating in accordance with conventional Musical Instrument Digital Interface (MIDI) standards, comprising:

a sound generation system comprising an amplifier and a speaker for generating said designed audible total sound from said plurality of composite sounds;

a plurality of sound signal generators, each of said plurality of sound signal generators being capable of generating one of said plurality of composite sounds, each of said plurality of composite sounds having a particular timbre, pitch, volume and dynamic response;

a data source for generating data representing timbre, pitch, volume and dynamic response, said data source comprising a user-activated randomizer for randomly selecting a random timbre and one or more random sound elements from a group comprising pitch, volume and dynamic response, said random timbre and one or more random sound elements being selected from a plurality of possible timbres, pitch levels, volume levels and dynamic responses.

33. The electronic sound designing system of claim 32 further comprising a memory, wherein said plurality of possible timbres, pitch levels, volume levels and dynamic responses are stored in said memory, said memory holding data defining 128 possible timbres, 4 possible pitch levels, 128 possible volume levels and 32 possible dynamic responses.

34. The electronic sound designing system of claim 33 wherein said data source comprises:

means for inputting a plurality of continuous analog sound modifiers and an associated analog-to-digital converter therefor;

means for inputting a plurality of switch sound modifiers, wherein said switch sound modifiers determine what will be randomized among said plurality of possible timbres, pitch levels, volume levels and dynamic responses associated with a given sound signal generator;

means for inputting a plurality of musical note inputs;

a scanner for monitoring for a change in said continuous analog modifiers, switch sound modifiers and said musical note inputs, wherein said scanner generates an event command based on said change by reading from said memory;

an event command buffer;

a processor for generating a sound signal generator command from said event command; and a memory for storing said data defining said designed total sound or one or more composite sounds comprising same.

* * * * *